US006392631B1

(12) United States Patent
Bertin et al.

(10) Patent No.: US 6,392,631 B1
(45) Date of Patent: May 21, 2002

(54) PROCESS FOR DISPLAYING DATA ON A MATRIX DISPLAY

(75) Inventors: Jean-Pierre Bertin, Guémené-Penfao; Emmanuel Jolly, Rennes, both of (FR)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/414,358

(22) Filed: Oct. 7, 1999

(30) Foreign Application Priority Data

Oct. 13, 1998 (FR) ..... 9812777

(51) Int. Cl.[7] ..... G09G 3/34

(52) U.S. Cl. ..... 345/103; 345/87; 345/98; 345/100

(58) Field of Search ..... 345/103, 99, 98, 345/100, 87

(56) References Cited

U.S. PATENT DOCUMENTS 4,824,212 A * 4/1989 Taniguchi ..... 345/103
4,985,698 A * 1/1991 Mano et al. ..... 345/103
5,426,447 A * 6/1995 Lee ..... 345/103
5,598,178 A * 1/1997 Kawamori ..... 345/93

FOREIGN PATENT DOCUMENTS

EP 0319292 6/1989 ..... G09G/3/20
EP 0434042 6/1991 ..... G09G/3/36
EP 0836173 4/1998 ..... G09G/3/36

OTHER PUBLICATIONS

Copy of Search Report.

* cited by examiner

*Primary Examiner*—Chanh Nguyen
*Assistant Examiner*—Fritz Alphonse
(74) *Attorney, Agent, or Firm*—Joseph S. Tripoli; Harvey D. Fried; Sammy S. Henig

(57) ABSTRACT

The present invention relates to a process for displaying data on a matrix display consisting of N data lines and M selection lines at the intersections of which are situated image points or pixels, the data lines being grouped into P blocks of N' data lines each with N=P×N', each block receiving in parallel one of the P data signals which is demultiplexed on the N' data lines of said block. According to this process, inside a block, the data lines are addressed according to a spatial order chosen in such a way as to minimize the coupling error between the data lines of two adjacent blocks.

6 Claims, 3 Drawing Sheets

PROCESS FOR DISPLAYING DATA ON A MATRIX DISPLAY

BACKGROUND OF THE INVENTION

The present invention relates to a process for displaying data on a matrix display, more particularly a matrix display consisting of N data lines and M selection lines at the intersections of which are situated image points or pixels. Moreover, the present invention relates to a matrix display of the above type controlled in such a way that the N data lines are grouped into P blocks of N' data lines each with N=P×N'.

DESCRIPTION OF PRIOR ART

Among matrix displays there are known in particular the liquid crystal screens used in direct vision or projection mode. These screens are generally composed of a first substrate carrying selection lines referenced hereinafter as lines and data lines referenced hereinafter as columns at the intersections of which are situated the image points and of a second substrate comprising a counter-electrode, the liquid crystal being inserted between the two substrates. The image points or pixels consist in particular of pixel electrodes connected by switching circuits such as transistors to the selection lines and to the data lines. The selection lines and the data lines are connected respectively to peripheral control circuits generally termed "drivers". The line drivers scan the lines one after another and close the switching circuits, that is to say render the transistors of each line passing in succession. On the other hand, the column drivers apply a signal corresponding to an information item to each column, i.e. they charge the electrodes of the selected pixels and modify the optical properties of the liquid crystal contained between these electrodes and the counter-electrode, thus allowing the formation of images on the screen. When the matrix display comprises a limited number of lines and columns, each column is connected by its own connection line to the column drivers of the screen. However, in the case of high-definition screens, the number of columns being very large, use is preferably made of multiplexing between the outputs of the column driver and the columns of the screen so as to reduce the number of tracks. Thus, in French Patent Application No. 96 00259 filed on Jan. 11, 1996, in the name of THOMSON-LCD, there is described a column driver for a matrix display using the principle of multiplexing. This column driver is represented in FIG. 1. In this case, the columns are grouped into P blocks 1 of N' columns, namely six columns C1, C2, C3, . . . ,C6 in the embodiment represented. Each block 1 comprises switching circuits, such as the transistors 3, one of the electrodes of which is linked to a column Ci and the other electrode of which is connected to the same electrode of the other transistors of the block, this set of electrodes being connected to a data input referenced DB1 for the first block, DB2 for the second block, DBP for the last block. The gates of the transistors 3 each receive a demultiplexing signal DW1, DW2, DW3, . . . , DW6. Each block has the same structure.

If the liquid crystal display comprises a valve of the SVGA 16/9 2:2 type with 1080 pixels per line for 600 lines, the structure of FIG. 1 comprises 180 blocks of 6 columns each. Specifically, each sampling signal DW1 to DW6 is connected to 180 columns and the video signal consisting of 180 D bits is transferred to the relevant pixel sequentially in blocks of 180 with the aid of 6 control signals DW in the order 1 to 6. Thus, for example, when the signal DW1 is active, the analogue voltage DB1 is transferred into pixel 0 associated with column C1 of the first block, the analogue voltage DB2 into pixel 6 associated with column C1 of the second block, the analogue voltage DB3 into pixel 12 associated with column C1 of the third block and the analogue voltage DB180 into pixel 1074 associated with column C1 of the $180^{th}$ block. Likewise, when the sampling signal DW2 is active, the analogue voltage DB1 is transferred into pixel 1 associated with column C2 of the first block, the analogue voltage, DB2 into pixel 7, associated with column C2 of the second block and so on for the six sampling signals used in the embodiment represented.

When this mode of addressing is used, it is found that, for a grey image, a darker fixed column structure appears which is related directly to the sampling and which is due to line/column coupling. This is because, when the first sampling signal DW1 activates the 180 gates of the transistors 3, the content of the video is loaded into pixels 0, 6, 12, 1074 which are then activated. In the same way, the second sampling signal DW2 will transfer the content of the video into pixels 1, 7, 13, 1075 and so on for the other sampling signals. However, the pixel voltage loaded by the sampling signal DW2 is not equal to that of the pixels associated with the sampling signal DW1 on account of the line/column coupling which acts as a capacitive divider. If the sampling signal DW2 undergoes one coupling, the sampling signal DW3 will undergo two and so on, as represented in the graph of FIG. 2 which shows the variation in the pixel voltage as a function of the sampling commands DWi in a block 1. The pixel voltage therefore decreases with each data transfer.

As represented in FIG. 3, a decrease is therefore observed in regard to the luminance for the columns inside a block, with a very large discrepancy in brightness in regard to the pixels corresponding to two adjacent blocks such as pixels 6 and 7, 13 and 14, etc. This difference in brightness creates the fixed column structure mentioned above.

SUMMARY OF THE INVENTION

The aim of the invention is therefore to propose a process for displaying data allowing this defect to be remedied.

Accordingly, the subject of the present invention is a process for displaying data on a display consisting of N data lines and M selection lines at the intersections of which are situated image points or pixels, the data lines being grouped into P blocks of N' data lines each with N=P×N', each block receiving in parallel one of the P data signals which is demultiplexed on the N' data lines of said block, characterized in that inside a block, the data lines are addressed according to a spatial order chosen in such a way as to minimize the coupling error between the data lines of two adjacent blocks.

Preferably, the spatial order is chosen in such a way as to obtain a coupling error of 2$\epsilon$ between two consecutively addressed data lines, $\epsilon$ representing the coupling error between two adjacent data lines of a block.

According to a preferred embodiment, the spatial order is governed by the function:

$$R(i) = Ent\frac{(N'+1)}{2} + (-1)^i * Ent\frac{(i)}{2}$$

where Ent is the integer part of the number with N' being the number of data lines per block and i varying from 1 to N'.

According to another characteristic of the present invention, the chosen spatial order inside a block is reversed alternately according to the selection lines. Preferably, an addressing, according to the chosen spatial order, is carried out during two successive selection lines and an addressing, according to the reversed spatial order, is carried out during two other subsequent successive selection lines.

The subject of the present invention is also a device for implementing the above process, characterized in that the device essentially includes a programmable logic circuit.

BRIEF DESCRIPTION OF THE DRAWINGS

Other characteristics and advantages of the present invention will become apparent in the description given below, this description being given with reference to the appended drawings in which.

To simplify the description below, in the figures the same elements bear the same references.

DESCRIPTION OF PREFERRED EMBODIMENTS

Figure 1:
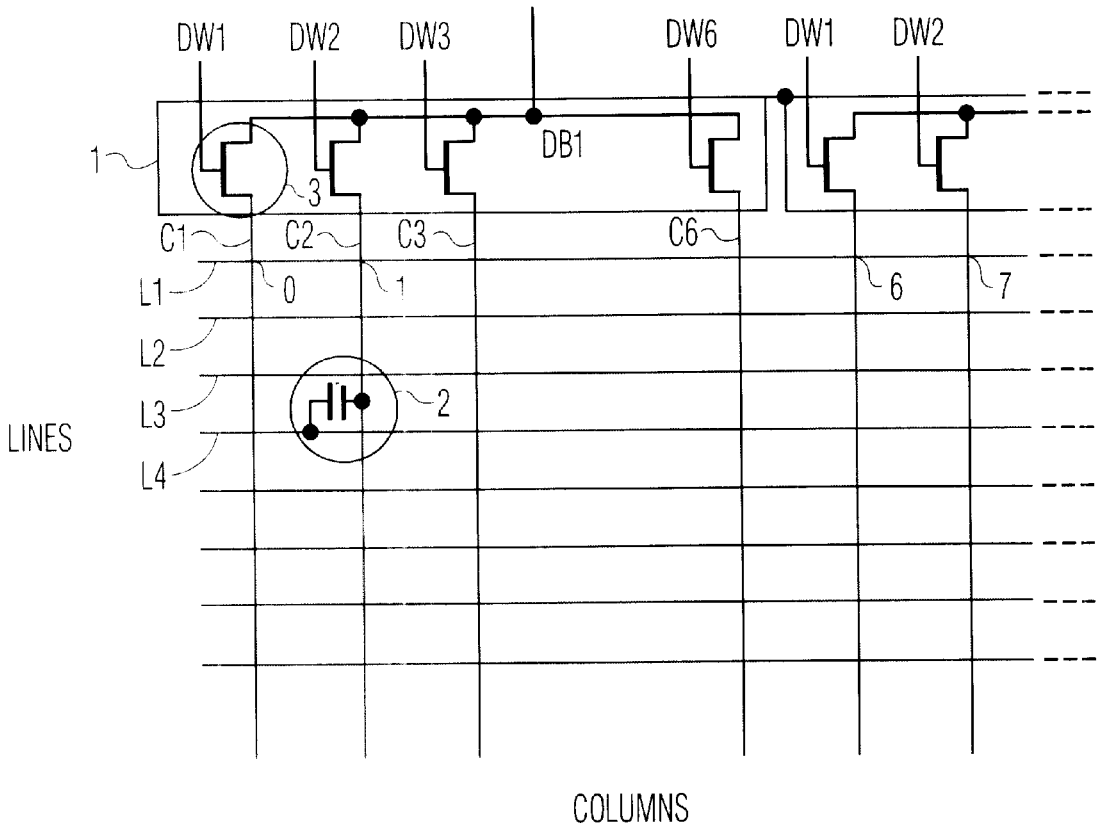
FIG. 1 already described is a diagrammatic representation of a matrix display in which the columns are grouped into blocks according to an embodiment used within the context of the present invention, FIGS. 2 and 3 already described are graphs respectively showing the variation in the pixel voltage as a function of the sampling commands between the blocks and the variations in luminance inside successive blocks.
Figure 2:
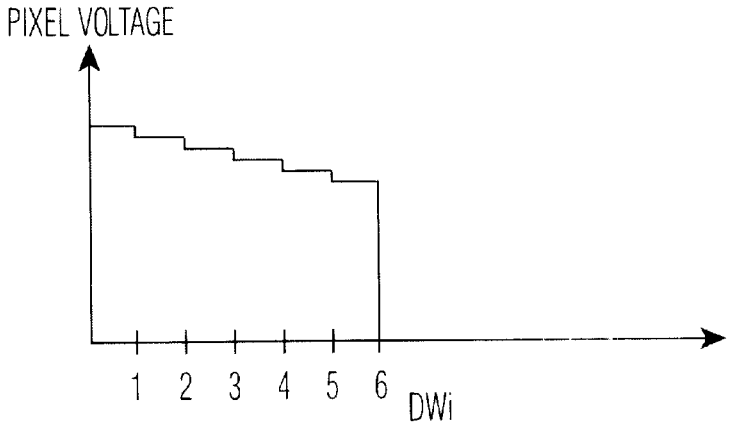
Figure 3:
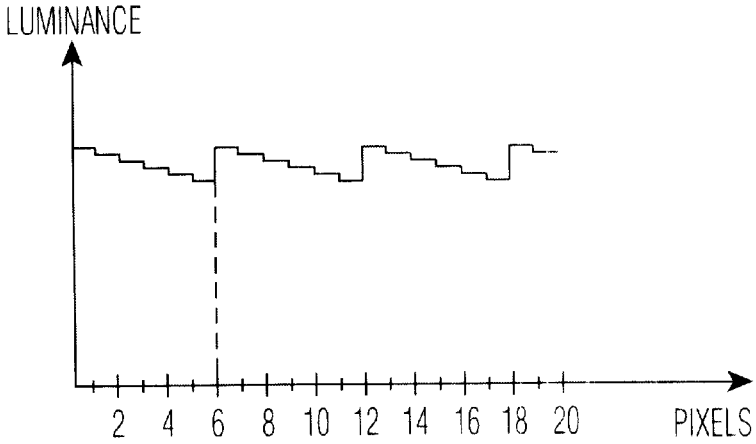

The process in accordance with the present invention is applied in particular to a matrix display of the type represented in FIG. 1. This display consists of N data lines or columns and M selection lines at the intersections of which are situated image points or pixels 2 symbolized by a capacitor. The N columns are grouped into P blocks 1 of N' columns each. By way of example, a block 1 of six columns is represented in FIG. 1. In the case of a screen used for video display comprising a valve of the SVGA type, the column control circuit will comprise 180 blocks of six adjacent columns and will operate with a sampling frequency of around 500 KHz. As represented in FIG. 1, each block 1 receives in parallel one of the P or 180 data signals which is demultiplexed by the signals DW1 to DW6 on the six columns of a block.

Figure 4:
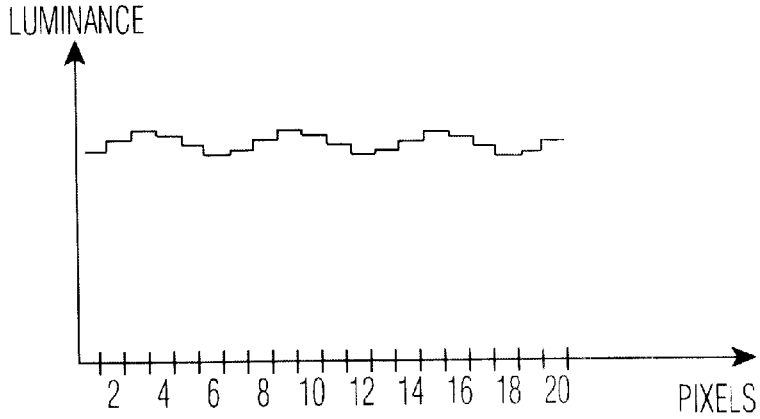
FIG. 4 is a graph representing the variations in luminance along a selection line when the columns are addressed according to the process in accordance with the present invention.

In accordance with the present invention, instead of sampling the signals DW1 to DW6 in succession, an addressing of the data lines is performed according to a spatial order chosen in such a way as to minimize the coupling error between the data lines of adjacent blocks. Thus, in the case of sampling on six columns, the demultiplexing signals are addressed in the following order, namely DW3, DW4, DW2, DW5, DW1, DW6. With this specific mode of addressing, it is appreciated that there are only two couplings between two adjacent an pixels, this giving rise to a very small difference in brightness, as represented in FIG. 4. In fact, with the process of the present invention, the luminance error is distributed spatially over the video line. More generally, when the number of signals Dwi is N', the spatial order is governed by the function:

$$R(i) = Ent\frac{(N'+1)}{2} + (-1)^i * Ent\frac{(i)}{2}$$

with N' where Ent is the integer part of the number with N' being the number of data items per block and i varying from 1 to N'.

According to another characteristic of the invention, the direction of scanning of the columns of a block is reversed at each line or preferably every two lines. More specifically, the signals DWi are read respectively in the order 3, 4, 2, 5, 1, 6 according to a first line or the first two lines and in the order 6, 1, 5, 2, 4, 3 according to the subsequent line or the subsequent third or fourth line.

The present invention also relates to a circuit allowing the implementation of this process. This circuit consists mainly of a programmable logic circuit which will be associated with a line counter determining the reversal of the direction of scanning.

Figure 5:
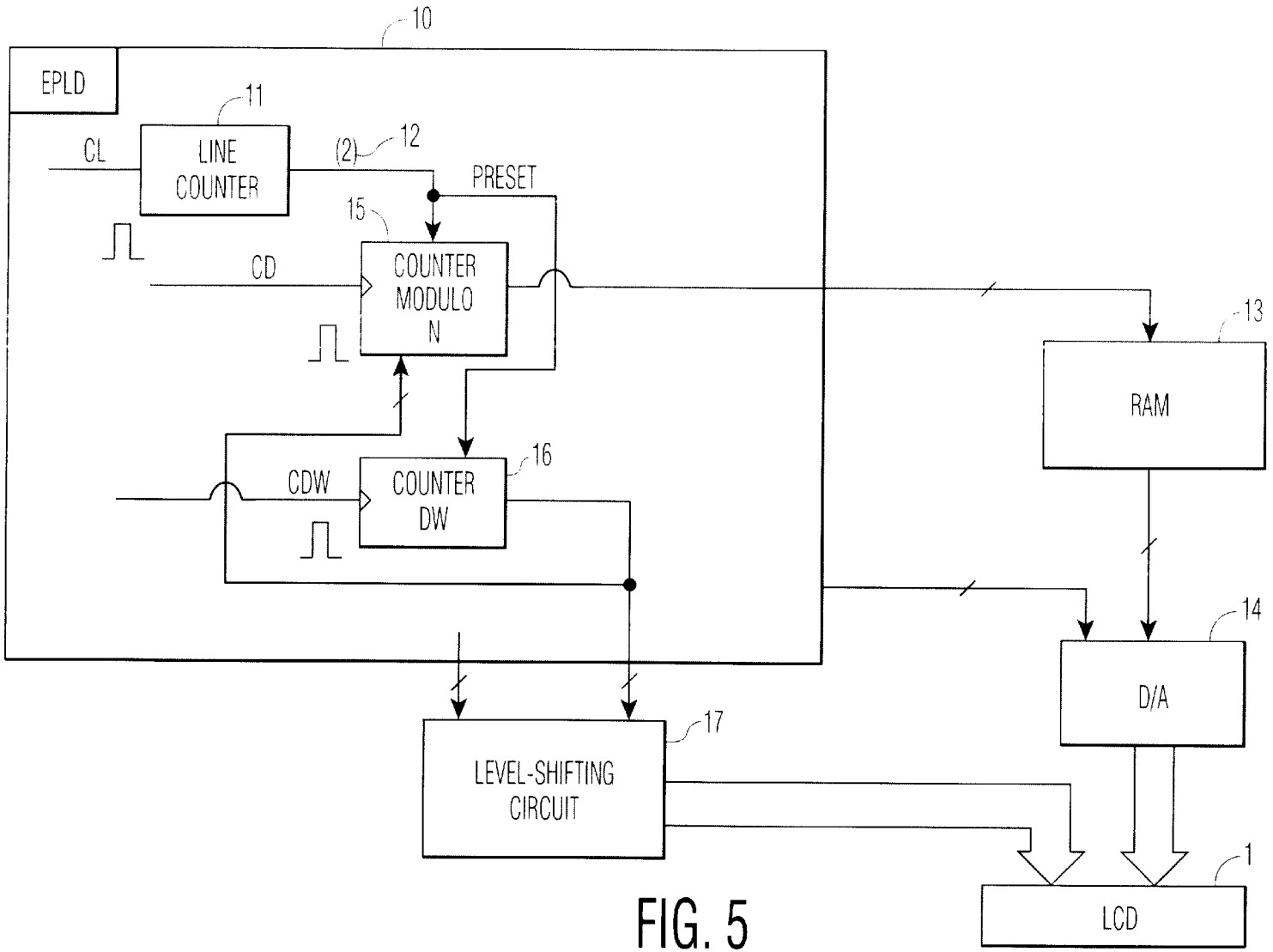
FIG. 5 is a diagrammatic representation of a programmable logic circuit allowing the implementation of the process of the present invention.

A circuit of this type is represented in FIG. 5. It essentially comprises a programmable logic circuit EPLD 10 which manages the order of dispatch of the video data DB stored in a RAM memory 13 to the LCD screen 1 as well as the direction of scanning of the demultiplexing signals DWi (i=1 to N'). This programmable circuit 10 essentially comprises a line counter 11 receiving a clock signal CL as input, the output of the counter 11 consists of the signal Preset which corresponds to the bit of order 2 of the word corresponding to the number of lines and is despatched to a counter 15 modulo N' and to a counter DW16 counting the number of multiplexing signals DWi. The counter 15 modulo N' is controlled by the data clock CD and also receives the output from the counter 16 on another input. Its manner of operation will be explained in more detail below. The counter DW16 is controlled by the clock DW, namely the signal DWC and its manner of operation will be explained in more detail below. The output of the counter 15 modulo N' is despatched as input to the RAM memory 13 in such a way as to transfer the P video data to a digital/analogue conversion circuit 14 provided upstream of the LCD screen 1 in the order of the DWi values. On the other hand, the output from the counter DW16 is despatched to a level-shifting circuit 17 addressing the selection lines of the LCD screen 1 and is also returned to the counter modulo N' 15.

The manner of operation of the programmable circuit 10 will now be described in greater detail. In accordance with the present invention, the order of scanning of the signals DWi in a block does not occur in succession but is carried out in the order 3, 4, 2, 5, 1, 6 or in the order 6, 1, 5, 2, 4, 3 in such a way as to minimize the error of coupling between two adjacent columns.

Thus, in the case of the embodiment represented allowing reversal of the direction of scanning every two lines, if the bit of order 2 output by the line counter 11 is equal to 0 (XXXXXX00 or XXXXXX01), the signals DWi are read in the order 3, 4, 2, 5, 1, 6 and the P or 180 items of video data stored in the line memory 13 are transferred to the D/A circuit 14 provided upstream of the LCD screen 1 in the order of the DWi according to the table below:

| DW | DB | column number |
|---|---|---|
| 3 | k<br>with k integer and $1 \leqq k \leqq P$ | $N' \times (k-1) + 3$<br>with k integer and $1 \leqq k \leqq P$ |

-continued

| DW | DB | column number |
|---|---|---|
| 4 | k<br>with k integer and $1 \leqq k \leqq P$ | $N' \times (k-1) + 4$<br>with k integer and $1 \leqq k \leqq P$ |
| N' | k<br>with k integer and $1 \leqq k \leqq P$ | $N' \times (k-1) + N'$<br>with k integer and $1 \leqq k \leqq P$ |

If the bit of order 2 output by the line counter 11 is equal to 1 (xxxxxx10 or xxxxxx11), the signals DWi are read in the order 6, 1, 5, 2, 4, 3 and the 180 items of video data are transferred to the D/A circuit 14 according to the order indicated in the following table:

| DW | DB | column number |
|---|---|---|
| N' | k<br>with k integer and $1 \leqq k \leqq P$ | $N' \times (k-1) + N'$<br>with k integer and $1 \leqq k \leqq P$ |
| 4 | k<br>with k integer and $1 \leqq k \leqq P$ | $N' \times (k-1) + 4$<br>with k integer and $1 \leqq k \leqq P$ |
| 3 | k<br>with k integer and $1 \leqq k \leqq P$ | $N' \times (k-1) + 3$<br>with k integer and $1 \leqq k \leqq P$ |

In more detail, the signal output by the line counter 11 referenced Preset is despatched respectively to the counter modulo N' 15 and to the circuit DW16. The counter modulo N' 15 is controlled by the data clock CD and operates in such a way that:

| | |
|---|---|
| If Preset = 0 | The video data are transferred as is |
| If Preset ≠ 0 | N' + 1 minus video data are transferred. |

Likewise, the counter DW16 controlled by the clock DWC operates as follows:

| | |
|---|---|
| If Preset = 0 | The words are transferred in the normal order, namely 3, 4, 2, 5, 1, 6. |
| If Preset ≠ 0 | The signals DWi are transferred in the reverse order. |

The information item output by the counter 16 is therefore despatched to the level-shifting circuit 17 in such a way as to address the selection lines of the LCD screen 1.

It is obvious to the person skilled in the art that this is merely one particular embodiment which may be modified without departing from the scope of the claims.

What is claimed is:

1. Process for displaying data on a matrix display comprising N data lines and M selection lines at the intersections of which are situated image points or pixels, the data lines being grouped into P blocks of N' data lines each with N=P×N', each block receiving in parallel one of the P data signals which is demultiplexed on the N' data lines of said block, wherein inside a block, the data lines are addressed according to a spatial order governed by the function:

$$R(i) = Ent\frac{(N'+1)}{2} + (-1)^i * Ent\frac{(i)}{2}$$

where Ent is the integer part of the number with N' being the number of data items per block and i varying from 1 to N'.

2. Process according to claim 1, wherein the chosen spatial order inside a block is reversed alternately according to the selection lines.

3. Process according to claim 2, wherein an addressing, according to the chosen spatial order, is carded out during two successive selection lines and an addressing, according to the reversed spatial order, is carried out during two other subsequent successive selection lines.

4. Circuit for implementing the process according to claim 1, wherein the circuit is a programmable logic circuit comprising:

a line counter receiving a clock signal as input and outputting a signal corresponding to the bit of order 2 of a word corresponding to the number of lines, a counter modulo N' controlled by a data clock and receiving the output of the line counter and outputting a signal to a memory containing video data, a counter counting the number of multiplexing signals receiving the output of the line counter, being controlled by a clock and outputting a signal sent to a driver of the matrix display.

5. Circuit according to claim 4, wherein the programmable logic circuit is associated with a line counter determining the reversal of the direction of scanning.

6. A programmable logic circuit for managing display of data on a matrix display comprising N data lines and M selection lines at intersections of which are situated image point or pixels, the date lines grouped into P blocks of N' data lines, each with N=P×N', each block receiving in parallel one of the P data signals which is demultiplexed on the N' data lines of said block the data lines addressed according to a spatial order for minimizing coupling error between the data lines of two adjacent blocks, said programmable logic circuit comprising:

a line counter receiving a clock signal as input and outputting a signal corresponding to the bit of order 2 of a word corresponding to the number of lines, a counter modulo N' controlled by a data clock and receiving the output of the line counter and outputting a signal to a memory containing video data, a counter counting the number of multiplexing signals receiving the output of the line counter, being controlled by a clock and outputting a signal sent to a driver of the matrix display.

* * * * *